US008058611B2

(12) United States Patent
Wouters et al.

(10) Patent No.: US 8,058,611 B2
(45) Date of Patent: Nov. 15, 2011

(54) SYSTEM FOR PREVENTING BACKFLOW IN AN ION SOURCE

(75) Inventors: Eloy R. Wouters, San Jose, CA (US); Christopher Mullen, Menlo Park, CA (US); Maurizio A. Splendore, Walnut Creek, CA (US); R. Paul Atherton, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 96 days.

(21) Appl. No.: 12/565,598

(22) Filed: Sep. 23, 2009

(65) Prior Publication Data

US 2011/0068263 A1 Mar. 24, 2011

(51) Int. Cl.
*H01J 49/26* (2006.01)

(52) U.S. Cl. ..... 250/288

(58) Field of Classification Search ..... 250/288, 250/281, 282

See application file for complete search history.

(56) References Cited

U.S. PATENT DOCUMENTS 5,412,208 A 5/1995 Covey et al.
6,759,650 B2 7/2004 Covey et al.
7,145,138 B1 12/2006 Thakur
7,199,364 B2 4/2007 Thakur
7,339,521 B2 3/2008 Scheidemann et al.
7,465,940 B2 12/2008 Franzen
2009/0194687 A1 8/2009 Jolliffe et al.
2009/0212210 A1 8/2009 Finlay et al.
2010/0163719 A1 * 7/2010 Loucks et al. ..... 250/281

FOREIGN PATENT DOCUMENTS

WO WO 2008/124264 A2 10/2008
WO WO 2008/129039 A2 10/2008

* cited by examiner

*Primary Examiner* — Kiet Nguyen
(74) *Attorney, Agent, or Firm* — Michael C. Staggs

(57) ABSTRACT

A system for preventing backflow as part of an ion source arrangement is introduced. Such a system incorporates a novel continuous flow guide within a source, such as an API ion source. In the spray direction, the cross-sectional area that defines the first portion of the internal volume initially decreases in a convergent-like manner and thereafter increases in a divergent-like manner towards the exit opening of the source housing. Such a flow guide has been designed as an integral part of an ion source housing to provide for an optimal unidirectional flow past a sampling orifice of a mass spectrometer inlet. Accordingly, the novel design of the present invention prevents recirculation and thus minimizes carryover, chemical noise, and source turbulence and as an added benefit, enables a user to easily clean such a system during maintenance.

27 Claims, 6 Drawing Sheets

SYSTEM FOR PREVENTING BACKFLOW IN AN ION SOURCE

BACKGROUND OF THE INVENTION

1. Field of the Invention

The present invention relates to the field of mass spectrometry, and more particularly to system that includes a novel internal volume (e.g., a continuous flow guide) configuration that provides for an optimal flow path within a mass spectrometer ion source housing.

2. Discussion of the Related Art

In LC-MS mass spectrometry analyte, ions are generated by nebulizing the ion-containing liquid at pressures around atmospheric in a chamber called the ion source housing. Some of this vapor enters the mass spectrometer's vacuum chamber for analysis. The remainder of the vapor, as well as the gases aiding the nebulizing and desolvation processes (sheath and auxiliary) need to exit the source housing through a different opening called a drain. To prevent contamination of surfaces in the source housing which can cause interference with the analysis of subsequent samples, so called carryover, it is important that the vapor-laden gases are removed swiftly.

A process that often occurs in conventional housings is back streaming/back drafting, wherein a counter flow of gases out of the drain region are caused by the flow of the high velocity nebulizing and desolvation gases directed towards the drain. This counter flow contains undesired contaminants and can cause stagnation of the vapor-laden gases which can lead to condensation of droplets on source surfaces and therefore contamination of such surfaces, which can lead to carryover. In particular, analyte circulating within an ion source housing creates a memory effect wherein the intensity of the analyte as read by a configured mass analyzer can be seen to decay over a period of time after introduction of the analyte/solvent mixture into the housing has ceased. Accordingly, if a second analyte is introduced too soon after the first analyte, the first analyte can still appear in a subsequent reading. This negatively impacts the performance of the mass spectrometer as expressed in the number of samples that can be analyzed per hour. Moreover, the carryover of analytes can sometimes lead to their re-entry into the chamber atmosphere and contribute to a background that reduces the signal-to-noise ratio of desired mass spectral runs.

Background information on a system and method that attempts to address the aforementioned problems through the use of an inner exhaust tube is described and claimed in U.S. Pat. No. 6,759,650, entitled, METHOD OF AND APPARATUS FOR IONIZING AN ANALYTE AND ION SOURCE PROBE FOR USE THEREIN," issued Jul. 6, 2004, to Covey et al, including the following, "Ions for analysis are formed from a liquid sample comprising an analyte in a solvent liquid by directing the liquid sample through a capillary tube having a free end so as to form a first flow comprising a spray of droplets of the liquid sample, to promote vaporization of the solvent liquid. An orifice member is spaced from the free-end of the capillary tube and has an orifice therein. An electric field is generated between the free-end of the capillary and the orifice member, thereby causing the droplets to be charged, and the first flow is directed in a first direction along the axis of the capillary tube. Two gas sources, or an arc jet of gas, provide second and third flows, of a gas, and include heaters for heating the second and third flows. The second and third flows intersect with the first flow at a selected mixing region, to promote turbulent mixing of the first, second and third flows, the first, second and third directions being different from one another, and each of the second and third directions being selected to provide each of the second and third flows with a velocity component in the first direction and a velocity component towards the axis of the capillary tube, thereby to promote entrainment of the heated gas in the spray, with the heated gas acting to assist the evaporation of the droplets to release ions therefrom. At least some of the ions produced from the droplets are drawn through the orifice for analysis."

Background information on a corresponding system and method that attempts to address the aforementioned problems also through the use of an inner exhaust tube is described and claimed in PCT Application No. WO 2008/124264 A2, entitled, DEVICE, APPARATUS AND METHODS FOR MASS SPECTROMETRY," published Oct. 16, 2008, to Tomany et al, including the following, "The invention comprises apparatus for use with atmospheric pressure ionization sources in which an aerosol is formed from a solution of a sample. The aerosol is received in a hollow member and discharged outside the chamber of the ionization source in order to reduce contamination of the ionization source itself by involatile material in the solution and by previously analysed samples. The hollow member is easily removable from the ionization source to facilitate cleaning and replacement. Ionization sources, mass spectrometers, and ion mobility spectrometers comprising the apparatus are also described."

Background information on a system and method that minimizes recirculation problems is described and claimed in U.S. Pat. No. 7,145,138, B1 entitled, EXHAUST PORT DESIGN FOR API SOURCES," issued Dec. 5, 2006, to Rohan A. Thakur, including the following, "The present invention provides Atmospheric Pressure Ionization (API) sources that minimize recirculation of droplets, solvent, and background gas. The APIs of the present invention comprise a chamber for ionizing samples for mass spectroscopy and similar analytical equipment. A spray probe on one side of the chamber directs a spray of a solvent and a sample as a cone of droplets that pass proximate to an ion exit orifice. Ions from the spray cone are extracted through the ion exit orifice. An exhaust port is disposed opposite the spray probe and aligned therewith to collect the spray cone. The design of the exhaust port, as described below, minimizes recirculation within the chamber to reduce the memory effect and to preserve the signal to noise ratio."

Therefore, a need exists for an improved source housing in which a novel internal volume (e.g., a continuous flow guide) has been designed to have an optimal flow path so as to enable a user to easily clean the entire ion source housing/internal volume apparatus and minimize undesired carryover. The present invention is directed to such a need.

SUMMARY OF THE INVENTION

Accordingly, the present invention provides for a system that prevents backflow in an ion source. Such a system includes: a housing chamber; a continuous flow guide configured within the housing chamber, wherein the continuous flow guide comprises a converging first volume and a diverging second volume coupled at a minimal cross-sectional area; a spray probe disposed within the continuous flow guide and configured to provide a spray plume along a desired axis within the continuous flow guide; one or more auxiliary gas inlets configured to provide an inert gas so as to combine with the spray plume and fill the converging first volume; an exhaust drain port operably coupled to the diverging second volume of the continuous flow guide; and a means to provide for a desired pressure differential within the converging first and the diverging second volume to induce a unidirectional flow past a sampling orifice of a mass spectrometer inlet, the unidirectional flow being further directed out of the exhaust drain port so as to prevent recirculation and thus minimize carryover, chemical noise, and source turbulence.

In accordance with another aspect of the present invention, a method for preventing backflow in an ion source as part of a mass spectrometer system is introduced. The method includes: providing a continuous flow guide configured within a housing chamber, wherein the continuous flow guide comprises a converging first volume and a diverging second volume coupled at a minimal cross-sectional area; providing a spray probe disposed within the continuous flow guide, the spray probe configured to direct a spray plume that further comprises ionized charged particles of one or more analytes along a desired axis within the continuous flow guide; providing one or more auxiliary gas inlets configured to provide an inert gas so as to combine with the spray plume and fill the converging first volume; and providing a desired pressure differential within the converging first and the diverging second volume to induce a unidirectional flow past a sampling orifice of a mass spectrometer inlet, wherein the unidirectional flow is thereafter directed out of an exhaust drain port so as to prevent recirculation of thus minimize carryover, chemical noise, and source turbulence.

Accordingly, the present invention provides for a system having an improved source housing/ion source design that includes a substantially reduced internal volume (e.g., a continuous flow guide) with respect to conventional designs. Such an arrangement, as disclosed herein, enables an optimal flow path that results in (1) ease of expansion of the introduced non-turbulent gas towards the exit, (2) prevention of back flows from the exit, and (3) reduced areas of stagnation.

DETAILED DESCRIPTION

Figure 1:
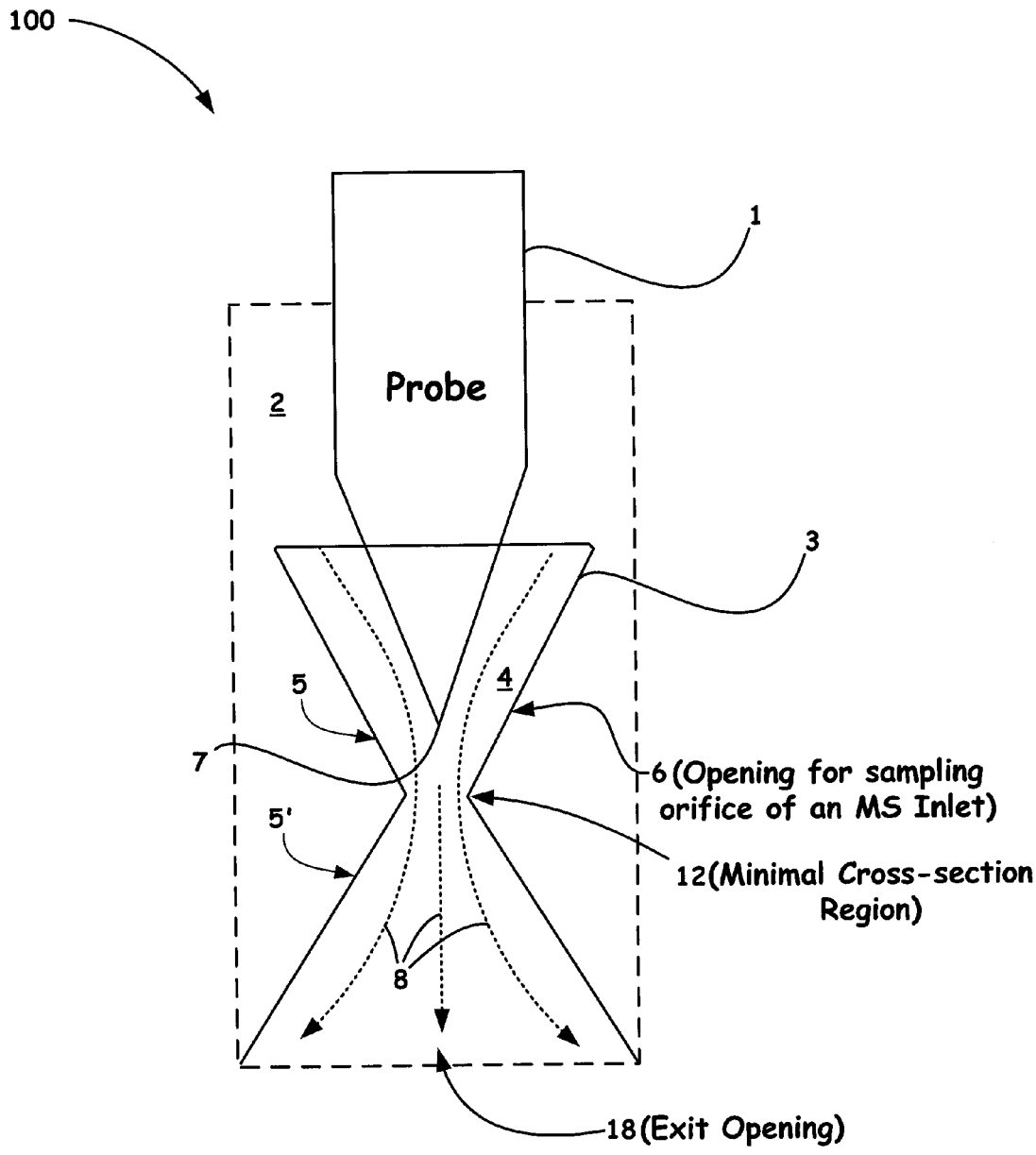
FIG. 1 shows an example ion source configuration of the present invention.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements. Additionally, it will be understood that any list of such candidates or alternatives is merely illustrative, not limiting, unless implicitly or explicitly understood or stated otherwise.

In addition, unless otherwise indicated, numbers expressing quantities of ingredients, constituents, reaction conditions and so forth used in the specification and claims are to be understood as being modified by the term "about." Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical values, however, inherently contain certain errors necessarily resulting from the standard deviation found in their respective testing measurements.

GENERAL DESCRIPTION

Ion-laden aerosol, after being sampled by an inlet to a mass spectrometer's vacuum system needs to be promptly flowed out of the ion source into a drain system. In non optimal source designs, this mixture is recirculated and is sampled (at progressively lower volume concentrations) over a long time span (tens of seconds to minutes). This causes so-called peak tailing, during which the mass spectrometer's response slowly returns back to the baseline level. During this time the peak area of a subsequent sample injection cannot be accurately determined as it sits on an elevated baseline of an earlier sample injection. This effect is generally called carryover. Other processes associated with a non ideal gas flow pattern towards a drain system include when the sample containing vapor-laden gases can "rain out", i.e. a condensate is formed on an interior surface of the ion source. This condensate can slowly be re-evaporated and cause a general baseline level increase which results in a coupled mass spectrometer instrument to operate in a non ideal fashion.

Moreover, non optimal gas flow circulation patterns in atmospheric pressure ion sources, e.g. caused by sharp surfaces/corners, "dead" volumes, high velocity gas jets, undersized drain channels, gas streams at non optimal relative angles, etc., can also cause so-called back streaming/back drafting of gas from the drain system, which may contain sample containing solvent vapors, plasticizers (such as phtalates), etc. This back drafting flow, when sampled by the mass spectrometer, can cause chemical noise, carry over effects, non optimal use of the limited ion capacity of an ion trap, and other spurious effects.

Accordingly, the present invention is directed to address the above described problems by providing methods and source arrangements (e.g., atmospheric pressure ionization (API) source arrangements) in a system that minimizes among other effects, carryover, chemical noise, and source turbulence via a configured continuous flow guide/ion sampling position, which is part of the ion source housing. As an example design according to the present invention, the continuous flow guide of the ion source housing, which operates as an airfoil, can be configured with a double conic-type shape, wherein the probe (e.g., a nebulizer probe) is mounted in a portion of decreasing diameter followed by a portion of increasing diameter towards the exit of the source, which collectively allows the gas to expand but does not allow for backflow. Alternative airfoil embodiments of the present invention include a design wherein the continuous flow guide of the source housing converges in the middle and then diverges subsequently in a manner that forms a Laval nozzle. As part of the benefits of such an airfoil design of the present invention, sharp surfaces/corners are minimized and thus the trapping of contaminants are also minimized so as to enable the ease of cleaning of the system during periods of routine maintenance.

In particular, to address the above described issues, the present invention provides for a novel continuous flow guide design (i.e., a nozzle conduit to control fluid flow), within an ion source housing such that a probe disposed within the continuous flow guide is along a desired axis wherein, in the spray direction, the cross sectional area that defines the first portion of the continuous flow guide initially decreases in a convergent-like manner and thereafter increases in a divergent-like manner towards the exit opening of the source housing. In an example embodiment, such a desired axis in the spray direction is often configured so as to be coincident with an axis that runs down the centerline of the converging and diverging axis. While such an arrangement is beneficial, it is to also be appreciated that the axis that includes the direction of the spray centerline axis does not necessarily have to be parallel to or coincident with the axis that includes the centerline of the converging and diverging axis.

Moreover, the ion probe sprayer tip, which is often beneficially positioned about where the divergent gas flows emanate, is capable of being moveably arranged before, at, or just after the minimal cross sectional area of the novel continuous flow guide configured within the housing chamber of the present invention. The opening of the mass spectrometer's vacuum chamber, as disclosed herein, is thus configured to intersect with such a novel continuous flow guide design via a sampling orifice configured in a sampling position within the continuous flow guide. Thus, as the unidirectional flow of material is directed past the configured sampling orifice, analytes of interest can be interrogated as provided by the design parameters of the present invention.

SPECIFIC DESCRIPTION

Turning now to the drawings, FIG. 1 illustrates a general example configuration of a system for preventing backflow in an ion source, shown generally designated by the reference numeral 100, that includes an ion source housing 2 and continuous flow guide 3 (i.e., a nozzle conduit to control fluid flow), which is capable of being coupled with various mass analyzing systems, such as, but not limited to, single stage analyzer systems (conventionally called tandem in time) capable of mass spectrometry, e.g., a time-of-flight (TOF) device, a linear ion trap (LIT), magnetic and electrostatic analyzers, a quadrupole, an ion cyclotron resonance (ICR) instrument, an orbitrap, or a Fourier Transform Mass Spectrometer (FTMS) or a variety of tandem mass spectrometers with more than one analyzer (e.g., tandem in space), as known to those of ordinary skill in the art.

As shown in FIG. 1, a probe 1 coupled with the continuous flow guide 3 of the source housing 2 (shown in phantom) collectively operate, as disclosed herein, in desired pressurized environments, such as, for example, a vacuum, a greater than atmosphere environment, often at an atmospheric pressure arrangement (e.g., as an atmospheric pressure ionization source (API)) to create ions that are beneficially mass analyzed by systems, as generally disclosed above. Thus, probe 1 of FIG. 1, often comprises ion sources that can be adapted to the configurations of the present invention and thus include, but are not strictly limited to, atmospheric pressure chemical ionization (e.g., APCI) sources, atmospheric pressure photoionization (APPI) sources, and often an electro-spray ionization (ESI) interface source.

In a beneficial source arrangement, the probe of FIG. 1 is configured to receive a dissolved analyte from a source, such as, a liquid chromatograph source (LC). Using such a combination enables a mixture of solvent and an analyte for interrogation, to be introduced as a fine droplet spray by the probe 1 into the source housing 2. In some instances, a sheath liquid in conjunction with the mixture of solvent and analyte material can be introduced in situations that involve high surface tension liquids but more often in collaboration with a nebulizing sheath gas (e.g., nitrogen) to aid in focusing of the analyte material and to aid in desolvation/evaporation by preventing formation of large droplets and droplet streams.

As a novel aspect of the present invention, a unidirectional flow path 8 (shown as dashed directional arrows) of the analyte material is urged along a direction to an exit opening 18 as collectively determined by, for example: gas inlet(s) (not shown) positioned to introduce an inert non-turbulent gas flow (e.g., nitrogen, air), a nebulizer gas flow (i.e., a sheath gas), and importantly, the converging/diverging design of the continuous flow guide 3 configured with a desired minimal cross-section region 12 that enables a desired unidirectional flow path 8.

Correspondingly, during the directed flow 8, ionized analytes are drawn out of the continuous flow guide 3 and source housing 2 through a sampling orifice (not shown), as received in an opening 6, that is operatively coupled to a mass spectrometer analyzer (not shown). It is to be noted that the arrangement of the opening 6 so as to receive the sampling orifice of a mass spectrometer inlet, is merely illustrative as to the positioning of a coupled mass spectrometer (not shown), but such a depiction is not meant to be limited to solely above the minimal cross-sectional area of continuous flow guide 3. For example, positions before, at or below the desired minimal cross-section region 12 but in a close proximity to the resultant neck of the two intersecting portions are equally applicable to the configurations of the present invention.

In the generalized example embodiment of FIG. 1, the continuous flow guide 3 of the ion source can include a substantially double conic-type shape having their individual centralized axes coincident throughout the structure. It is to be noted that a converging first portion 5 of the continuous flow guide 3 can also be configured shorter than a second diverging portion 5'. However, while such an arrangement is beneficial, it is also to be noted that the configurations of the present invention can include configurations wherein the first converging portion is longer than the second portion and it is to also be appreciated that either portion can include varying internal cross-sections, such as, but not limited to, circular, elliptical, or parallelepiped, in order to conform to the design parameters of the present invention.

Moreover, it is also to be appreciated, as discussed briefly above, that the central axes for both of the volumes that make up and run along the continuous flow guide 3 do not necessarily require them to be parallel or coincident. In addition, the directional axis flow out of probe 1 can be on axis with one or both of the axes that make up continuous flow guide 3 but, as another arrangement, can be angled (e.g., of less than 90 degrees) in a slight manner so as to not be coincident with either axis of continuous flow guide 3.

In an example method of operation, solvent/analyte material along with a nebulizing sheath gas is introduced as part of the mass spectrometry method that includes appropriate ionization mechanisms, such as, for example, electrospray ionization. In particular, solvent/analyte material is introduced as a charged spray plume via a configured tip 7 of probe 1 mounted in desired position (e.g., moveably positioned) before, substantially at, or after the minimal cross-sectional region 12 within the channel 4 that is formed within continuous flow guide 3. Simultaneously, an inert auxiliary non-turbulent gas (e.g., nitrogen, air) having a desired flow is introduced by one or more inlet channels (not shown) so as to direct a desired flow of the spray cone (i.e., analyte/solvent material/residual nebulizer gas) along a path, as shown by the dashed directional arrows 8.

As part of the novel design of the present invention, as the liquid solvent/analyte emerges from the opening of the probe tip, the auxiliary flow coming from an inlet(s) (not shown) meets the resultant charged spray cone in a non-turbulent fashion within the channel 4 in a manner that provides a pressure differential between the converging first portion 5 and the second diverging portion 5' of the continuous flow guide 3 design, as shown in FIG. 1 of the present invention. In addition, the introduced non-turbulent auxiliary inert gas can be heated via known techniques in the art so as to also aid in desolvation of the material introduced by tip 7 of probe 1 to improve sensitivity in collected mass spectral measurements of charged analyte material. Because of the design of the continuous flow guide 3 and chosen operating parameters (e.g., initial auxiliary gas pressure differentials, exhaust pumping rate, etc.), the gas flow 8 velocity increases continuously from the initial introduced substantially stagnant auxiliary gas area up to about the narrowest cross-section of region 12 that forms a nozzle-like aperture. Thereafter, the overall flow 8 beyond the minimal cross-section region 12 is thereafter accelerated as the flow expands in the second portion of increasing diameter 5'. Thus, the novel configuration and chosen design and input parameters, e.g., continuous flow guide 3 design (e.g., lengths and shapes of the converging and diverging first 5 and second 5' portions, nozzle area), auxiliary gas fill pressure, pumping speed at the exit opening 18, auxiliary gas heating, etc., as shown in FIG. 1, produces an overall beneficial unidirectional flow of the residual material past a disposed analyte sampling orifice (not shown) that results in an ion source 2/continuous flow guide 3 configuration that substantially eliminates any backflow recirculation so as to minimize recirculation of species within the source, carryover, chemical noise, and source turbulence.

Figure 2:
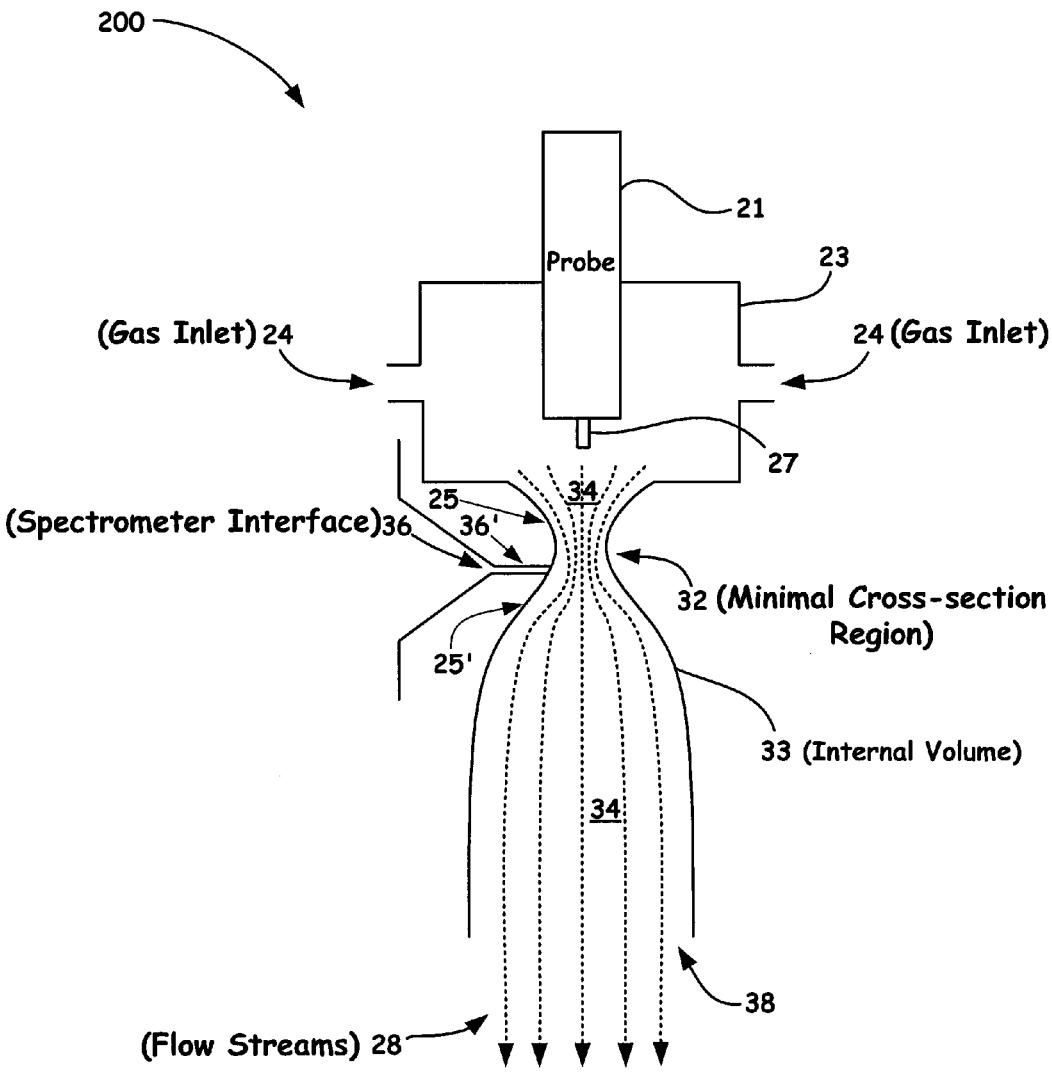
FIG. 2 shows another beneficial example ion source embodiment having a Laval-like nozzle.

FIG. 2 shows another example beneficial system that prevents backflow in an ion source, now shown generally designated by the reference numeral 200, that includes, an ion source housing 23/continuous flow guide 33 (i.e., nozzle conduit) configuration of the present invention. In particular, FIG. 2 shows an example embodiment that incorporates a novel continuous flow guide 33 configuration wherein the minimal cross-sectional area 32 structure approximates a Laval-like nozzle, as detailed below. As similarly discussed above, while the axes for both the converging and diverging portions of the continuous flow guide 33 are illustratively shown to be co-axial, it is to be noted that the central axes for both of the portions that make up and run along the continuous flow guide 33 do not necessarily require them to be parallel or coincident. Moreover, the directional axis flow out of probe 21 can be on axis with one or both of the axes that make up continuous flow guide 33 but, as another arrangement, can be angled (e.g., of less than 90 degrees) in a slight manner so as to not be coincident with either axis of continuous flow guide 33.

Thus, turning back to FIG. 2, the probe 21, as similarly discussed above, is thus configured to receive a dissolved analyte from a source, such as, a liquid chromatograph source (LC). As before, the arrangement enables a mixture of solvent and an analyte for interrogation to be introduced as a fine droplet spray by the probe 21 into an ion source housing 23 and often via collaboration with a nebulizer sheath gas (e.g., nitrogen) for focusing/desolvation/and evaporation and in some instances a sheath liquid, as known and understood by those of ordinary skill in the art, in situations that involve high surface tension liquids.

As similarly discussed above with respect to the embodiment of FIG. 1, the introduced non-turbulent (i.e., substantially stagnant) auxiliary gas and the desired analytes and residual solvent material as provided by probe 21, is thus urged along a unidirectional path 28 (shown as dashed directional arrows) via the design of the present invention.

It is to be understood that any means as understood by those skilled in the art to provide pressure differentials between the converging and diverging portions of the continuous flow guide 33 can be utilized to induce such a continuous desired flow. For example, the auxiliary gas introduced into chamber 23/upper portion 25 of continuous flow guide 33 can be filled (e.g. at greater than an atmosphere) to provide a pressure differential with respect to lower portion 25' of continuous flow guide 33 so as to initiate the continuous flow mechanism out to a coupled exhaust drain port 38. As another arrangement, a pump (not shown), e.g., a roughing pump, a roots blower pump, a flow meter, a pressure controller and/or a Venturi pump, alone or in operative conjunction with the desired introduced gas fill pressure (at about atmosphere or greater) can be designed to operate at a pumping speed when coupled to the exhaust drain port 38 to also assist in desired pressure differentials within the continuous flow guide 33. In any chosen arrangement, the means initiates and provide for the resultant overall unidirectional flow within the continuous flow guide 33. When using a pumping means, an operator can optimize the flow rate out to the exhaust drain port 38 so as to throttle the pumping rate speed of configured pump(s) and induce desired pressure differentials, auxiliary gas heating, etc., so as to uniformly direct the Laval-nozzle flow 28 at the desired operating pressure.

As similarly stated above with respect to the embodiment of FIG. 1, as a directed unidirectional flow 28 is provided past a sampling orifice 36' of a spectrometer interface 36, ionized analytes are drawn out of the continuous flow guide 33 through the spectrometer interface 36 that enables coupling to a mass spectrometer analyzer (not shown). It is to be noted again that the arrangement of the spectrometer interface 36, as generally depicted in FIG. 2, is merely illustrative as to positioning of a coupled mass spectrometer (not shown), but such a depiction is not meant to be limited to the general position shown in FIG. 2. In particular, positions before, at or below the narrowest region but in a close proximity to the resultant neck (minimum cross section region 32) of the configuration are equally applicable to any of the embodiments of the present invention.

In contradistinction to the embodiment of FIG. 1, one or more inlets 24 are now shown to introduce the non-turbulent flow of the auxiliary inert (inactive) gas (e.g., nitrogen, air) into the ion source housing 23 in any directional manner (shown as an orthogonal arrangement for illustrative purposes in FIG. 2) so as to couple with the spray cone of analyte/solvent/sheath gas emanating out of probe tip 27. As an added beneficial configuration, the introduced non-turbulent auxiliary inert gas can be heated via known techniques in the art so as to also aid in desolvation of the material introduced by probe 21 of which improves sensitivity in collected mass spectral measurements of the charged analyte material.

As before, in a method of operation, analyte/solvent material often with an accompanying nebulizing sheath gas, is introduced as part of the mass spectrometry method of electrospray ionization. In particular, analyte/solvent material is introduced via a configured tip 27 of probe 21 mounted (e.g., moveably positioned) in a desired position before, substantially at, or after the minimal cross-sectional region 32 within the channel 34 that is formed within continuous flow guide 33. Simultaneously, an inert auxiliary gas (e.g., nitrogen, air) having a predetermined non-turbulent flow rate is introduced by one or more inlet channels 24 so as to aid in directing the overall collective flow of material along a path 28 (denoted as flow streams), as shown by the directional arrows within channel 34.

Thus, as the liquid solvent/analyte spray cone emerges from the opening of tip 27 of probe 21, the inert auxiliary gas flow coming from inlets 24, as shown by example as being perpendicular to probe tip 27 in FIG. 2, meets the emerging spray cone in a non-turbulent fashion (e.g., substantially stagnant fashion).

As part of the unique design of the present invention, as shown in FIG. 2, the structure of the continuous flow guide 33, now includes a structure illustratively shown to approximate a Laval-like configuration, as known to those of ordinary skill in the art. Generally, Laval nozzles are made up to include convergent-divergent configurations, which are narrow in the middle, forming a throat, as generally depicted in the minimal cross-sectional area shown by the reference character 32. The convergent first portion 25 of the nozzle is generally shorter than the second portion 25', wherein the flow begins to accelerate from substantially stagnant movement up to about subsonic speeds that approach Mach 1 speeds at the minimal cross-section area 32. However, while the convergent first portion 25 of the nozzle is generally shorter than the second portion 25', it is also to be noted that the configurations of the present invention can include configurations wherein the first converging portion is longer than the second portion and it is to also be appreciated that either portion can include varying internal cross-sections, such as, but not limited to, circular, elliptical, or parallelepiped, in order to conform to the design parameters of the present invention.

Such Laval configurations coupled with desired means to induce pressure differentials (e.g., known in the art pumping means, desired fill gas pressures within first portion 25) result in a gas flow velocity that increases at sub-sonic flow rates provided by the pressure differential continuously from the area of the initial introduced analyte/solvent spray cone/auxiliary gas until it reaches the narrowest cross-section of region 32 that forms the Laval nozzle-like throat. Thereafter, the resultant pressure drop at the minimal cross-sectional area 32 causes the inert gas(s) and any residual analyte/solvent to be directed through the minimal cross-sectional area 32 and out to the expanding divergent second portion 25' so as to accelerate up to supersonic velocities that result in a unidirectional flow throughout the length of the divergent second portion 25'. Accordingly, the overall configuration and operating parameters beneficially produces an ion source system configuration 200 that substantially eliminates any backflow of material via recirculation so as to minimize carryover, chemical noise, and source turbulence.

Figure 3:
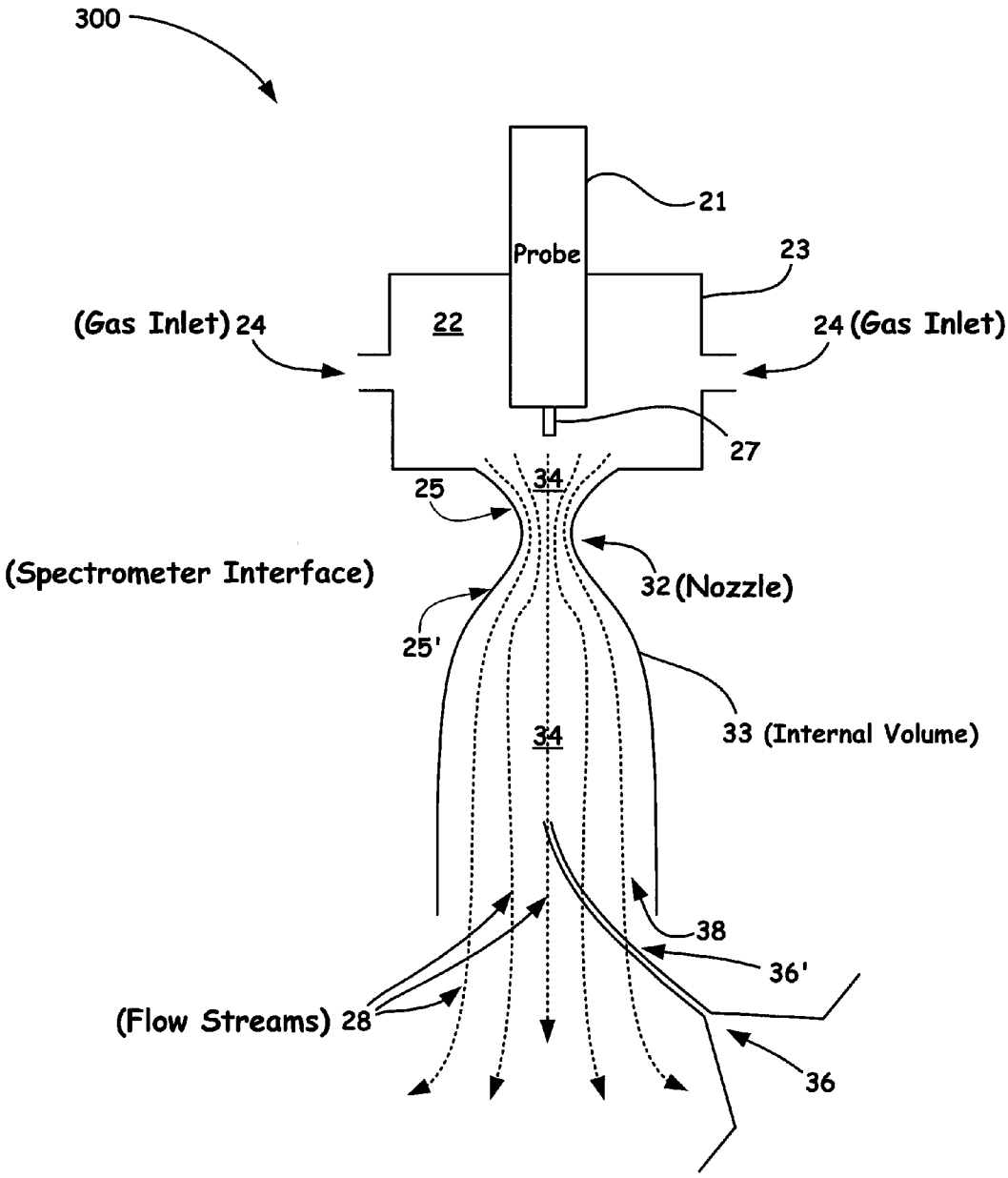
FIG. 3 shows an alternative arrangement of the configuration shown in FIG. 2, wherein the spectrometer interface is configured to receive the analyte material along the directed flow path provided by the continuous flow guide geometry of the present invention.

FIG. 3 shows an alternative novel internal Laval-like nozzle volume configuration of the present invention, as designated by the reference numeral 300, which is substantially similar to the configuration of the embodiment shown in FIG. 2, except for the positioning of the spectrometer interface, which includes a sampling orifice 36 having an extended portion 36' disposed within the divergent second portion 25' in a position to enable the resultant unidirectional gas flow 28 to be directed past the sampling orifice of the extended portion 36' and out to an exhaust port (not shown). Accordingly, all like reference numerations are duplicated. In contradistinction to the embodiment shown in FIG. 2, the beneficial configuration of FIG. 3 provides for the spectrometer interface sampling orifice 36 to be disposed within the divergent end (i.e., second portion 25') in a manner that can analyze any portion of the flow 28 for mass spectroscopy purposes. Accordingly, introduced gas pressures and/or one or more pumping means (not shown), e.g., a roughing pump, a roots blower pump, a flow meter, a pressure controllers and/or a Venturi pump capable of being arranged about the spectrometer interface 36 and as coupled to the divergent second portion 25' enables, as similarly discussed above, the pressure differentials so as to provide for the substantial unidirectional flow that eliminates any backflow of material via recirculation so as to minimize carryover, chemical noise, and source turbulence.

Figure 4:
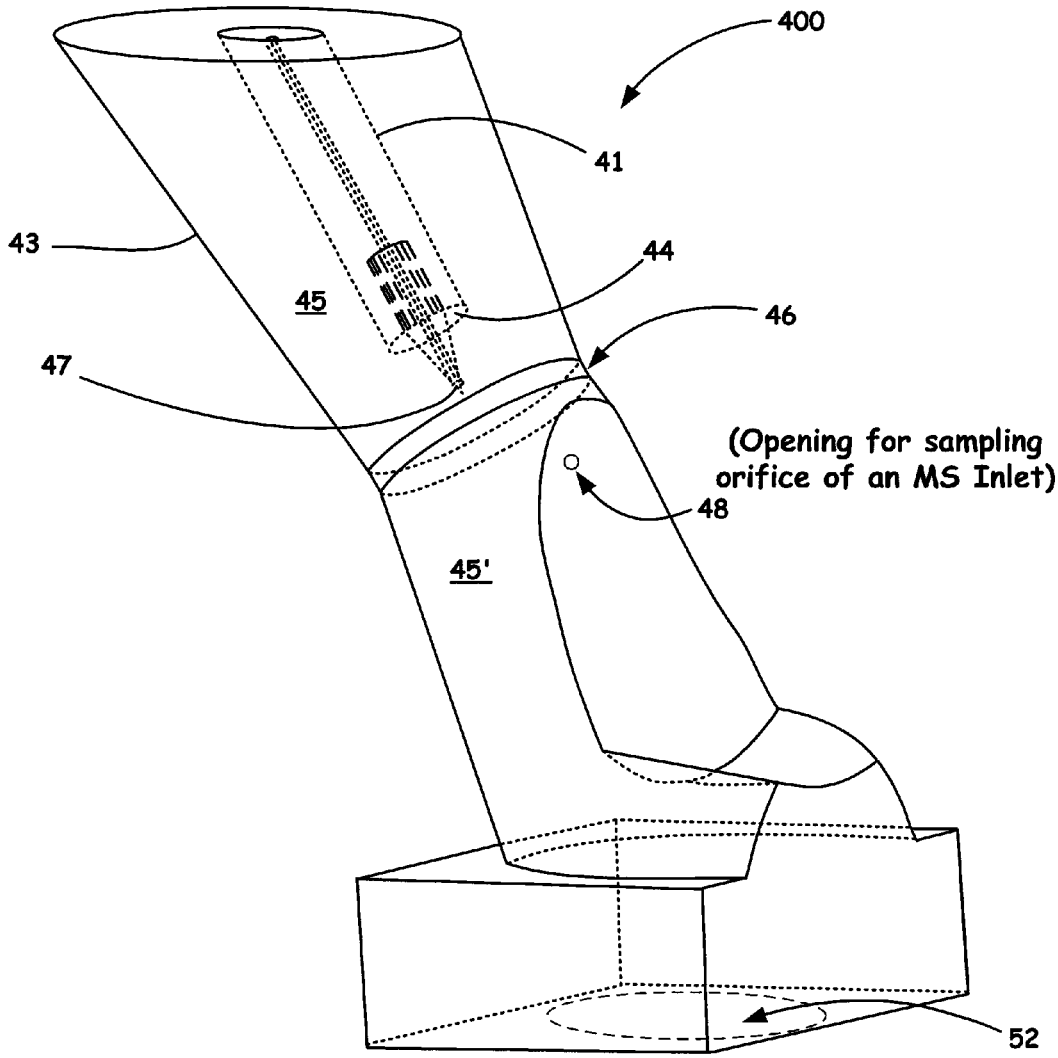
FIG. 4 shows an alternative example continuous flow guide/ion source housing arrangement of the present invention.

FIG. 4 shows an alternative novel continuous flow guide of the present invention, as designated by the reference numeral 400, which is capable of being arranged within an ion source housing (not shown for simplicity).

As generally shown in FIG. 4, the probe 41 enables a mixture of solvent and an analyte for interrogation to be introduced as a fine charged droplet spray into an ion source continuous flow guide 43 (note: ion source housing not shown). In this example embodiment, the source probe 41, is shown by example, as known in the art, as a central tube with an annular chamber configured to provide an annular flow of sheath gas (e.g., nitrogen) for desolvation and evaporation of the analyte material. Not shown in FIG. 4 is the ionizing mechanism, such as, for example, electrospray ionization arrangement, for ionizing the analyte from the resultant droplet spray out of tip 41.

As part of the operation of the apparatus shown in FIG. 4, ionized analyte is drawn out of the continuous flow guide 43 for analysis through an opening 48 configured to receive a sampling orifice as part of a mass spectrometer inlet (not shown). Such charged analyte material is then capable of being guided and analyzed by, for example, a mass spectrometer instrument, e.g., a coupled mass analyzer (not shown). The remainder of the unused analyte/solvent/sheath gas is thereafter directed by the novel converging and diverging continuous flow guide 43 structure having a minimal cross-section region 46, as similarly discussed above, so as to be directed through a drain port 52 that operates as an exhaust means. As similarly stated before, introduced gas fill pressures within the upper converging portion of continuous flow guide 43 and/or a pumping mechanism (e.g., a roughing pump, a roots blower pump, a flow meter, a pressure controllers and/or a Venturi pump) operatively coupled to the drain port 52 shown in FIG. 4, can provide the means to induce the desired pressure differentials within the continuous flow guide 43 so to initiate and sustain the overall unidirectional flow throughout the structure.

In an example method of operation, solvent/analyte material along with a nebulizing sheath gas is introduced as part of a mass spectrometry method known and understood by those skilled in the art. In the present configuration, solvent/analyte material is introduced as a charged spray plume via probe 41 having a configured tip 47 mounted (e.g., moveably positioned) in desired position before, substantially at, or after the minimal cross-sectional region 46 within the channel that is formed within continuous flow guide 43. Before and/or simultaneously with the introduced material from probe tip 47, and in structural contrast to the example design of FIG. 2, an inert auxiliary non-turbulent gas (e.g., nitrogen, air) is introduced via an annular inlet channel 44 so as to run substantially parallel to directed flow of the spray cone (i.e., analyte/solvent material/residual nebulizer gas) in order to fill the volume of the converging upper portion 45 of continuous flow guide 43.

Thereafter, similar to the workings of the example embodiment of FIG. 2, the resultant pressure drop at the minimal cross-sectional area 46 causes the inert gas(s) and any residual analyte/solvent to be directed through and out to the expanding divergent second portion 45' and accelerated at up to about supersonic velocities that results in an overall unidirectional flow throughout the length of the divergent second portion 45' so as to minimize/eliminate deleterious recirculation of material within the system.

Figure 5:
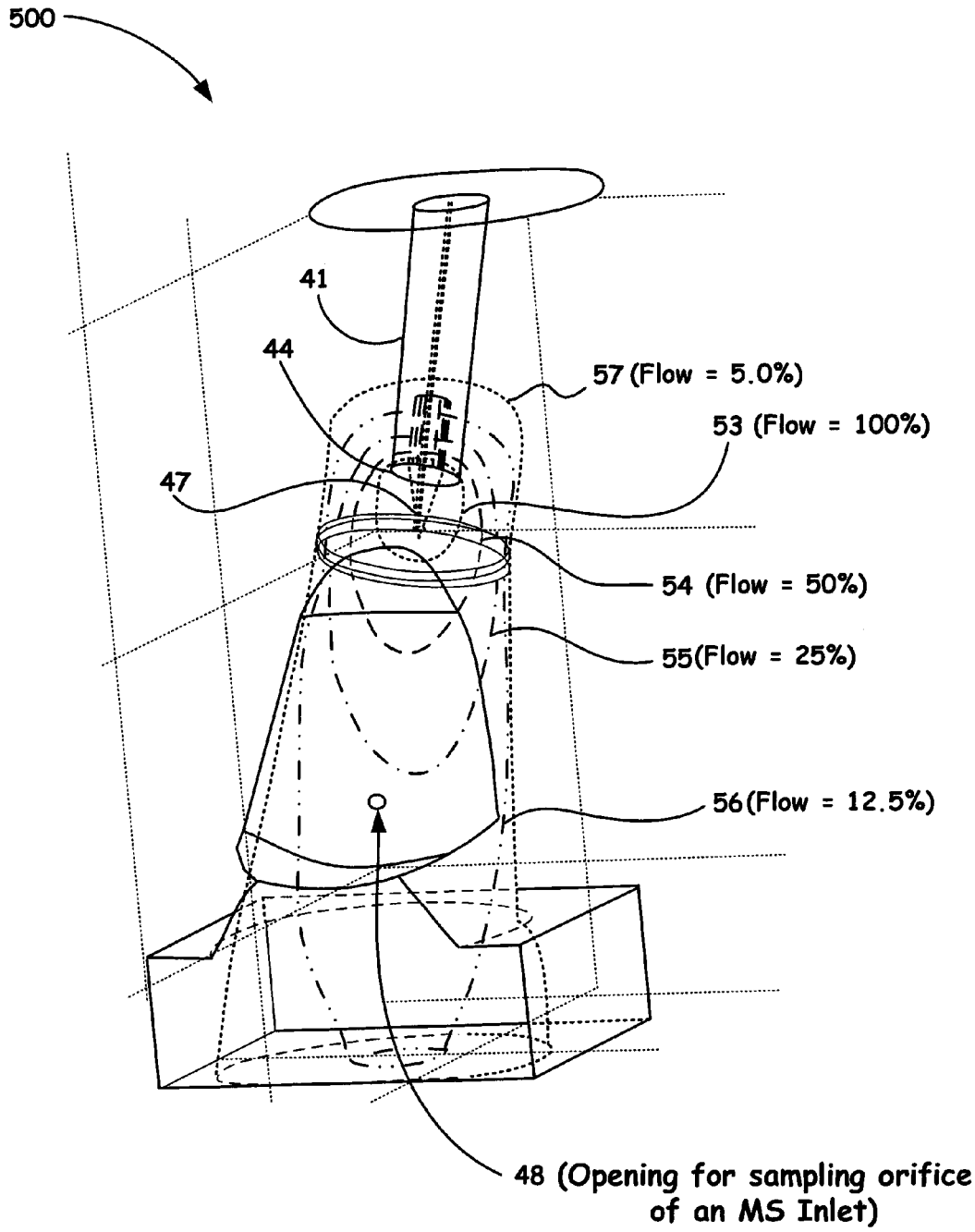
FIG. 5 shows a comparison of flow profiles as calculated using computational fluid dynamics as provided by the example embodiment of FIG. 4.

FIG. 5 shows a comparison of flow profiles as calculated using computational fluid dynamics as provided by the example embodiment of FIG. 4. As similarly referenced in FIG. 4, the probe tip 47 of probe 41 enables a mixture of solvent and an analyte for interrogation to be introduced as a fine charged droplet spray into an ion source continuous flow guide of the present invention and interrogated via a sampling orifice (not shown) of a mass spectrometer inlet as coupled to the opening 48, as discussed above. Also, an inert (inactive) auxiliary non-turbulent gas (e.g., nitrogen, air) is introduced before and/or simultaneously with the introduced material from probe tip 47, via an annular auxiliary inlet channel 44 configured to flow such auxiliary gas substantially parallel (e.g. co-linear) to the directed flow of the spray cone (i.e., analyte/solvent material/residual nebulizer gas) so as to fill the volume of the converging upper portion of the continuous flow guide and initiate, if desired, the unidirectional flow when operated within the design parameters of the present invention. Accordingly, the displayed calculated flow velocity isosurface profiles of 100% 53, 50% 54, 25% 55, 12.5% 56, and 5.0% 57, as shown in FIG. 5, when using the continuous flow guide design of FIG. 4, indicates that there is only flow downwards and there is no flow in the volume that could cause droplets to migrate upwards.

Figure 6:
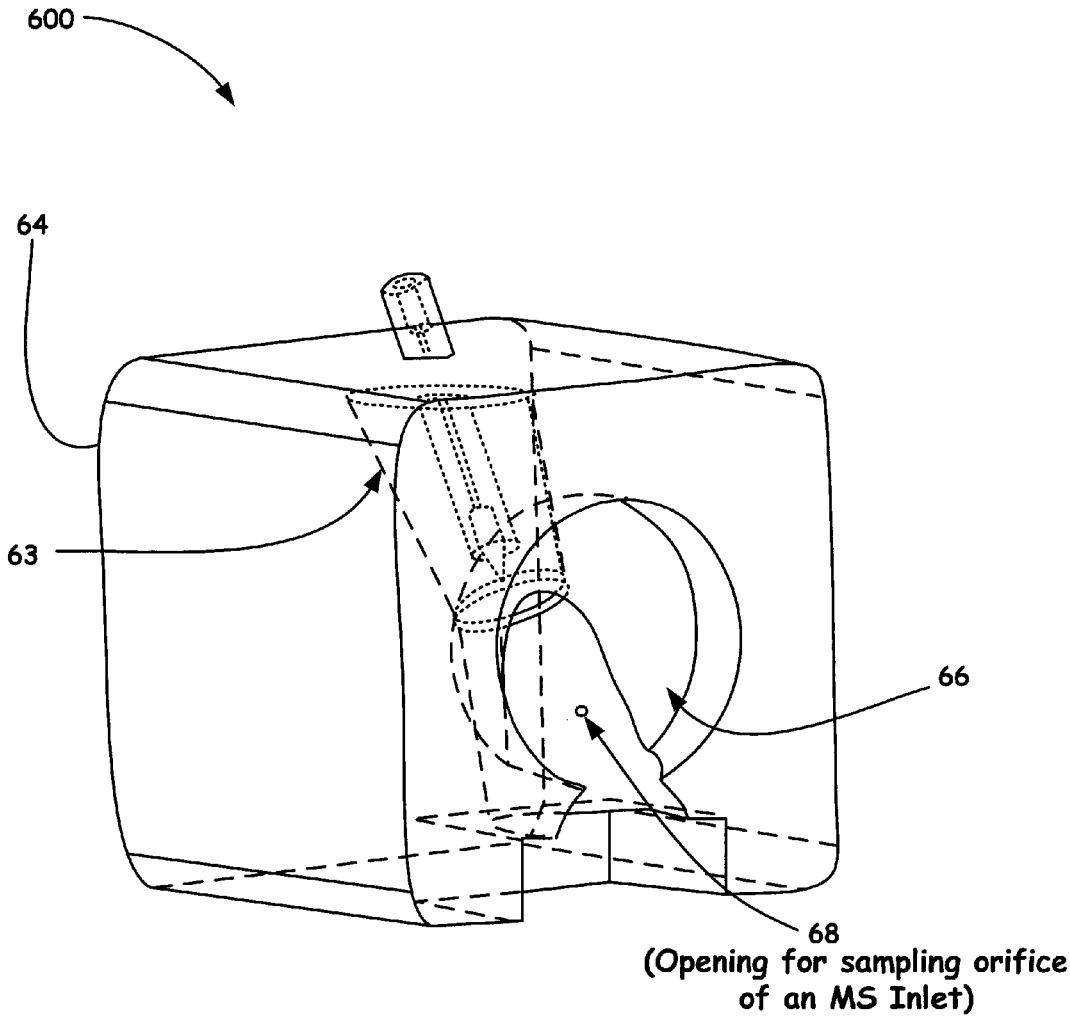
FIG. 6 shows a different perspective of the novel continuous flow guide of the present invention as arranged within the ion source housing.

FIG. 6 shows an example arrangement, as generally designated by the reference numeral 600, having a continuous flow guide 63 of the present invention, as similarly shown in the example configuration of FIG. 4. Accordingly, the general depiction shown in FIG. 6 illustrates an example configuration of a continuous flow guide 63/ion source housing 64 embodiment that is designed to couple to a mass spectrometer instrument (not shown) via an aperture 66 as provided by the housing 64. As also generally shown, an opening 68 is depicted in the cut-out portion of the continuous flow guide 63 to illustrate an example entry means for a sampling orifice (not shown) to be disposed within a desired region of the continuous flow guide 63. In general, analytes/solvent material/inert gas is introduced into the continuous flow guide 63 in a manner, as described above, that results in a unidirectional flow direction. As the resultant unidirectional flow of the collective material is directed past the sampling orifice (not shown) as received via the opening 68, desired analytes are capable of being interrogated by way of the sampling orifice and further directed for mass spectroscopy analysis.

It is to be understood that features described with regard to the various embodiments herein may be mixed and matched in any combination without departing from the spirit and scope of the invention. Although different selected embodiments have been illustrated and described in detail, it is to be appreciated that they are exemplary, and that a variety of substitutions and alterations are possible without departing from the spirit and scope of the present invention.

The invention claimed is:

1. A system for preventing backflow in an ion source, comprising:

a housing chamber;

a continuous flow guide configured within said housing chamber, wherein said continuous flow guide comprises a converging first volume and a diverging second volume coupled at a minimal cross-sectional area;

a spray probe disposed within said continuous flow guide and configured to provide a spray plume along a desired axis within said continuous flow guide;

one or more gas inlets configured to provide an inert gas in a non-turbulent fashion so as to combine with said spray plume and fill said converging first volume;

an exhaust drain port operably coupled to said diverging second volume of said continuous flow guide; and means to provide for a desired pressure differential within said converging first volume and said diverging second volume to induce a unidirectional flow past a sampling orifice of a mass spectrometer inlet additionally configured within said continuous flow guide, said unidirectional flow being further directed out of said exhaust drain port so as to prevent recirculation and thus minimize carryover, chemical noise, and source turbulence.

2. The system of claim 1, wherein said continuous flow guide comprises a Laval nozzle.

3. The system of claim 2, wherein said Laval nozzle produces a unidirectional supersonic flow within said diverging second volume out to said exhaust drain port.

4. The system of claim 1, wherein said continuous flow guide comprises a double conic coupled at said minimal cross-sectional area.

5. The system of claim 1, wherein said converging first volume and said diverging second volume comprise varying internal diameters.

6. The system of claim 1, wherein said converging first volume and said diverging second volume comprise at least one varying cross-sectional shape selected from: a parallelepiped, an elliptical, and a circular shape.

7. The system of claim 1, wherein the length of said converging first volume is greater than the length of said diverging second volume.

8. The system of claim 1, wherein the length of said converging first volume is less than the length of said diverging second volume.

9. The system of claim 1, wherein ionized analytes of said spray plume are drawn out of said sampling orifice for analysis.

10. The system of claim 9, wherein said sampling orifice is received through an opening of said continuous flow guide.

11. The system of claim 9, wherein said sampling orifice is received through an opening configured about said minimal cross sectional area of said continuous flow guide.

12. The system of claim 9, wherein said sampling orifice is disposed within said diverging second volume so as to interrogate analytes within said flow.

13. The system of claim 1, wherein said spray probe is moveably arranged to at least a position selected from: before, at, and just after said minimal cross sectional area of said continuous flow guide.

14. The system of claim 13, wherein said desired axis of said spray probe is at an angle of less than 90 degrees from an axis as defined by said converging first volume.

15. The system of claim 1, wherein the axes for both of said converging first volume and said diverging second volume are non-parallel.

16. The system of claim 1, wherein the axes for both of said converging first volume and said diverging second volume are non-coincident.

17. The system of claim 1, wherein said one or more gas inlets comprises an annular inlet to provide an inert gas substantially parallel to the directed flow of said spray plume.

18. The system of claim 1, wherein said inert gas is heated.

19. The system of claim 1, wherein said continuous flow guide operates as an airfoil.

20. The system of claim 1, wherein said means to provide for a desired pressure differential comprises at least one pump selected from: a roughing pump, a roots blower pump, a flow meter, a pressure controller and a Venturi pump.

21. A method for preventing backflow in an ion source, comprising:

providing a continuous flow guide configured within a housing chamber, wherein said continuous flow guide comprises a converging first volume and a diverging second volume coupled at a minimal cross-sectional area;

providing a spray probe disposed within said continuous flow guide, said spray probe configured to direct a spray plume that further comprises ionized charged particles of one or more analytes along a desired axis within said continuous flow guide;

providing one or more gas inlets configured to provide an inert gas in a non-turbulent fashion so as to combine with said spray plume and fill said converging first volume; and providing a desired pressure differential within said converging first volume and said diverging second volume to induce a unidirectional flow past a sampling orifice of a mass spectrometer inlet additionally configured within said continuous flow guide, wherein said unidirectional flow is thereafter directed out of an exhaust drain port so as to prevent recirculation of thus minimize carryover, chemical noise, and source turbulence.

22. The method of claim 21, wherein the step of providing a pressure differential further comprises throttling the pumping rate speed of a pump so as to provide said unidirectional flow at a desired operating pressure.

23. The method of claim 22, wherein said pump comprises at least one pump selected from: a roughing pump, a roots blower pump, a flow meter, a pressure controller and a Venturi pump.

24. The method of claim 21, wherein said induced unidirectional flow comprises supersonic speeds.

25. The method of claim 21, wherein said sampling orifice of said mass spectrometer inlet is configured to interrogate said charge particles of said one or more analytes within said unidirectional flow.

26. The method of claim 21, wherein said inert gas provided by said one or more gas inlets is directed substantially parallel to the directed flow of said spray plume.

27. The method of claim 21, wherein said inert gas is heated.

* * * * *